United States Patent [19]

Sawanishi et al.

[11] Patent Number: 4,562,114

[45] Date of Patent: Dec. 31, 1985

[54] WATER-ABSORBING ACRYLIC FIBERS

[75] Inventors: Shigeru Sawanishi; Mitsuru Wakitani, both of Okayama, Japan

[73] Assignee: Japan Exlan Company Limited, Osaka, Japan

[21] Appl. No.: 702,422

[22] Filed: Feb. 14, 1985

Related U.S. Application Data

[63] Continuation of Ser. No. 401,982, Jul. 26, 1982, abandoned.

[30] Foreign Application Priority Data

Aug. 10, 1981 [JP] Japan ..... 56-125509

[51] Int. Cl.[4] ..... D02G 3/00

[52] U.S. Cl. ..... 428/372; 428/398; 428/400

[58] Field of Search ..... 428/364, 373, 374, 398, 428/376, 372, 400; 8/115.5

[56] References Cited

U.S. PATENT DOCUMENTS

| | | | |
|---|---|---|---|
| 3,460,897 | 8/1969 | Lowes | 8/115.5 |
| 3,929,946 | 12/1975 | Orito et al. | 264/341 X |
| 4,130,525 | 12/1978 | Kobashi et al. | 524/869 |
| 4,143,200 | 3/1979 | Radlmann | 428/398 X |
| 4,163,078 | 7/1979 | Reinehr et al. | 428/373 |
| 4,180,617 | 12/1979 | Reinehr et al. | 428/398 |
| 4,316,937 | 2/1982 | Tanaka et al. | 428/376 |
| 4,336,214 | 6/1982 | Reinehr et al. | 428/376 X |
| 4,366,206 | 12/1982 | Tanaka | 428/373 |
| 4,442,173 | 4/1984 | Takegami et al. | 428/372 |

FOREIGN PATENT DOCUMENTS

| | | | |
|---|---|---|---|
| 118909 | 9/1981 | Japan | 264/182 |

*Primary Examiner*—Lorraine T. Kendell

*Attorney, Agent, or Firm*—Wenderoth, Lind & Ponack

[57] ABSTRACT

Novel porous water-absorbing acrylic fibers composed of not less than 90 weight % of an acrylonitrile polymer and having dispersed therein less than 10 weight % of a water-absorbing resin particles containing carboxyl groups (represented by —COOX wherein X is H, $HN_4$ or an alkali-metal) and having a degree of water-swellability of 10–300 cc/g, the particle diameter of which resin is not larger than 0.5$\mu$ at absolute dryness, the carboxyl groups in the water absorbing resin present at least in the outer layer of the fibers being of the type where X is H, and in the inner portion being of the type where X is $NH_4$ or an alkali metal, said fibers containing pores not smaller than 0.2$\mu$ in their largest diameter in the inner layer of the fibers and said fibers having a water holding ratio not lower than 20%. The acrylic fibers provided are novel, porous and water-absorbing, having a stable water-absorbing ability which will not be easily lowered by heat treatment, etc. The fibers are excellent in physical properties such as strength, elongation, etc. and in practical properties such as spinnability, etc. and are greatly improved in dyeability.

3 Claims, No Drawings

WATER-ABSORBING ACRYLIC FIBERS

This is a continuation of now abandoned application Ser. No. 401,982, filed July 26, 1982.

BACKGROUND OF THE INVENTION

1. Field of the Invention

The present invention relates to water-absorbing acrylic fibers, and more particularly it relates to porous water-absorbing acrylic fibers especially excellent in dyeing, containing a specific water-absorbing resin and having pores only in the inner layer of the fibers.

2. Description of the Prior Art

Since acylic fibers, like other synthetic fibers such as polyamide, polyester, etc. fibers, are lacking in water- and moisture-absorbing abilities, when used as material for underwear, sheeting, sportswear, summer wear, etc. it has been conventional practice in most cases to use them as mixed spun fabrics with cotton, rayon, etc. so that they can be worn comfortably.

Numerous trials have been made to improve the water- and moisture-absorbing abilities of acrylic fibers, but to date none proposed have satisfactory properties.

For example, when producing acrylic fibers composed of a single component by wet-spinning, if the porous structure of the swollen gel filaments is fixed, acrylic fibers showing a water-absorbing ability can be obtained, but they involve intrinsic disadvantages in that the micropores obtained by this method are unstable and will readily disappear in the subsequent drying step or by ironing, resulting in a lowered water-absorbing ability, extremely high absorption of spinning oil and poor color fastness.

Many proposals have been made on methods of producing micropores in the filaments by spinning a spinning solution to which a specified inorganic or organic substance has been added, and thereafter removing the added substance. However, such methods will pose essential problems including pollution of solvent by said substance or aggravation of working environment, complication of the production process such as the recovery of said substance, and therefore such methods cannot be evaluated as industrially advantageous methods.

Several techniques have been also proposed in which water- and moisture-absorbing abilities are given to acrylic fibers by partially hydrolyzing the fibers. However, such fibers having a large amount of carboxyl groups introduced to the fiber surface will show a remarkable decrease in the physical properties and color fastness, and also will not be able to avoid a sticky feel when they have absorbed water. Therefore, such methods are not satisfactory means in practical use.

Under such circumstances, we made an intensive study to eliminate the above-mentioned disadvantages and to provide water absorbing acrylic fibers excellent in practical properties, in an industrially advantageous manner. As a result, we have found that, by compounding a particular water-absorbing resin, it is possible to produce water-absorbing acrylic fibers having practical properties and having no problems in the production process such as spinnerette clogging, filament breakage, filament entanglement, filament fusion, etc. On the basis of this discovery we filed an application as Japanese Patent Publication No. 35286/1982.

However, even this prior application has defects in dyeing peculiar to porous fibers, for example, dyeing unevenness resulting from a fast dyeing speed of the fibers in low temperature regions, necessity of a large quantity of dyes to be used in comparison with ordinary acrylic fibers because of poor color development of the fibers. Therefore, an improvement of the fibers has been demanded from such a viewpoint.

STATEMENT OF THE INVENTION

In view of such situation, we conducted further studies to provide novel porous water-absorbing acrylic fibers having a stable water-absorbing ability not easily lowered by heat treatment, etc., which fibers are excellent in physical properties such as strength, elongation, etc. and in practical properties such as spinnability and greatly improved in dyeing characteristics. As a result, we have found that, by compounding a particular water-absorbing resin and suppressing the generation of pores in the fiber outer layer, it is possible to provide porous water-absorbing acrylic fibers improved especially in dyeing characteristics, in an industrially advantageous manner, without problems in the production process. This finding led us to the present invention.

Therefore, an object of the present invention is to provide a novel water-absorbing acrylic fibers which have a stable water-absorbing ability that will not be readily lowered by heat treatment, etc. and which are excellent in physical properties such as strength and elongation and in practical properties such as color fastness, spinnability, etc. Another object is to provide an industrially advantageous means for producing water-absorbing acrylic fibers which are free from any sticky feel upon water absorption, without problems in production such as spinnerette clogging, filament breakage, filament entanglement, filament fusion, and also without problems in the recovery of the added substance, aggravation of working environment, etc. Other objects of the invention will become apparent from the following description.

The water-absorbing fibers which can attain the above-mentioned objects are composed of not less than 90 weight % of polymer of acrylonitrile (hereinafter abbreviated as AN) and less than 10 weight % of a water-absorbing resin containing carboxyl groups (represented by —COOX wherein X is H, $NH_4$ or an alkali-metal) and having a degree of water swellability of 10–300 cc/g, the particle diameter of which resin is not larger than 0.5$\mu$ at absolute dryness, the carboxyl groups of the water-absorbing resin present at least in the outer layer of the fibers being acid type (—COOH), the inner layer of the fibers having pores not smaller than 0.2$\mu$ in their largest diameter, and the water-holding ratio of said fibers being not less than 20%.

DESCRIPTION OF PREFERRED EMBODIMENT

In the following the present invention will be explained in detail. Firstly, as the AN polymers of the present invention, any of those used in the production of acrylic fibers known heretofore may be used, and no limitation is placed on the polymer. However, it is preferable to use a copolymer of not less than 80 weight %, preferably not less than 90 weight %, of AN and the remainder of another vinyl monomer, from a viewpoint of fiber physical properties, dyeability, etc.

Secondly, there will be described the water-absorbing resin to be compounded with the above-mentioned AN polymers.

As such resins, any may be employed as long as they contain carboxyl groups (represented by —COOX wherein X is H, $NH_4$ or an alkali-metal) in an amount of preferably not less than 1.5 m mol/g, more preferably not less than 3.0 m mol/g, have a degree of water-swellability of 10–300 cc/g, preferably 20–150 cc/g and a particle diameter not larger than 0.5μ, preferably not larger than 0.2μ, and are insoluble in water and AN polymer solvents.

In order to attain the objects and effects of the present invention, it is necessary that the particle diameter and the degree of water-swellability of the water-absorbing resin should be selected within the recommended ranges of the present invention. Only on the condition that a water-absorbing resin satisfying such characteristics should be employed, it is possible to produce water absorbing acrylic fibers having excellent practical properties in an industrially advantageous manner, without problems in the production process. It is also necessary that the water-absorbing resin should contain carboxyl groups and that the carboxyl groups present at least in the fiber outer layer should have been converted into acid type (—COOH). Only by employing such technical means, it is possible to provide fibers having, only in the fiber inner layer, preferably not less than 5 pores, the longest diameter of which is not smaller than 0.2μ.

If the resin is so selected to have a crosslinking ratio (crosslinking density) of 1–15, preferably 2–10, per 400 repeating units of the polymer composing the resin, it is possible to further improve the spinnability of an AN polymer spinning solution compounded with said resin, in cooperation with the particle diameter characteristics. In this way, it is possible to produce fibers having a sufficient strength, elongation and water-absorbing properties.

No limitation is placed on methods of producing such a water-absorbing resin if the above-mentioned characteristics recommended in the present invention are satisfied. However, the following method will be useful in that it can produce a resin having such characteristics, in an industrially advantageous manner.

When a cross-linked AN copolymer having a particle diameter not larger than 0.5μ, preferably not larger than 0.2μ, which is composed of preferably not less than 50 weight %, more preferably not less than 70 weight %, of AN, based on the total amount of the monomers composing the polymer, and definite amounts of a crosslinking monomer and another vinyl monomer copolymerizable with AN, or an aqueous dispersion of such a crosslinked AN copolymer, is reacted, in the usual way, with an alkaline substance so as to introduce carboxyl groups into said copolymer, it is possible to produce, in an industrially advantageous manner, a resin having a degree of water-swellability of 10–300 cc/g, preferably 20–150 cc/g or an aqueous dispersion of said resin.

As the above-mentioned cross-linking monomers, there may be mentioned cross-linking monomers having two or more copolymerizable double bonds in the molecule, such as for example diesters, triesters or tetraesters of acrylic acid or methacrylic acid, allyl esters of unsaturated carboxylic acids, dially esters of polyvalent carboxylic acids, divinyl acid anhydrides, divinyl sulfone, methylenebisacrylamide, divinylbenzene and its alkyl- or halogen-substituted products and/or cross-linking monomers having at least one epoxy group in the molecule, such as glycidyl esters or unsaturated glycidyl ethers of the above-mentioned unsaturated carboxylic acids or unsaturated sulfonic acids. By using such a cross-linking monomer as the copolymerization component so as to cause it to cross-link during or after polymerization, the cross-linkage can be easily obtained. Among others, it is desirable to use, as the copolymerization component, cross-linking monomers having two or more copolymerizable double bonds in the molecule and being highly resistant to alkali, such as divinyl sulfone, methylenebisacrylamide, divinylbenzene, etc.

As regards the production of the above-mentioned cross-linked AN copolymers having the fine particle diameters, it can be advantageously carried out by employing, for example, U.S. Pat. No. 4,130,525 filed by the same applicant as that of the present invention.

By using, as such a water absorbing resin, a resin in which a cross-linked AN copolymer coexists, the miscibility with the fiber-forming matrix polymer (AN polymer) or the spinnability can be further improved. There is no limitation on the methods of producing a water-absorbing resin in which a cross-linked AN polymer coexists, but the water-absorbing resin can be advantageously produced by suitably selecting the vinyl monomer composing the cross-linked An copolymer or by regulating the hydrolytic condition so as to partially hydrolyze only the surface layer of the crosslinked AN copolymer, leaving the unreacted portion of the copolymer, or by grinding down the remaining resin particles of the core portion by means of a colloid mill, ball mill, etc. so that at least a part of the cross-linked AN copolymer will be exposed on the surface of the water-absorbing resin.

As the compounding ratio of such water-absorbing resins, it is necessary that it is less than 10 weight %, preferably within the range of from 0.5 to 7%. If the ratio is out of the lower limit of the range, it will be impossible to give a sufficient water-absorbing ability to the fibers to be finally obtained, and if the ratio exceeds the upper limit of the range, it will be impossible to avoid such problems as filament breakage upon filament spinning.

A method of producing the water absorbing acrylic fibers of the present invention will be explained in the following. As such a method any method can be employed so far as fibers having the properties aimed at in the present invention can be obtained. However, in order to obtain such fibers in an industrially advantageous manner, it is desirable to employ the following method.

A spinning solution is prepared by dissolving an AN polymer in a known solvent. After a predetermined quantity of a water-absorbing resin containing salt type carboxyl groups (—COOX′ wherein X′ is $NH_4$ or an alkali-metal) or preferably an aqueous dispersion of said resin is mixed with said spinning solution, it is wet-spun in the usual way and the resulting fibers are water-washed and acid-treated. After the gel fibers thus obtained are subjected to heat-stretching and drying-compacting treatment, the fibers are further subjected to wet-heat relaxing treatment, and if desired, to crimping treatment, oiling treatment, acid treatment, etc., preferably followed by drying treatment in the temperature range of from 105° to 170° C.

As the aqueous dispersion of the water-absorbing resin to be suitably compounded in the spinning solution, it is desirable to use an aqueous dispersion of a resin concentration of from 2 to 30 weight %, preferably from 5 to 20 weight %, and further to use one having a viscosity of not larger than 1000 cp prepared by adding to said aqueous dispersion, a part of the organic or inorganic solvent for preparing the spinning solution and/or another inorganic salt (Glauber's salt, sodium nitrate, etc.), because the dispersibility of said dispersion to the spinning solution and the spinnability of the resulting spinning solution can then be still more improved.

The process step of subjecting the water-washed gel fibers to the acid treatment is important in obtaining the product of the present invention. By the acid treatment, the salt type carboxyl groups in the water-absorbing resin present in the outer layer of the gel fibers are converted into acid type carboxyl groups (—COOH) so that the water-swelling power of the water-absorbing resin in the fiber outer layer is practically eliminated, which can suppress the generation of pores in the fiber outer layer in the subsequent steps. The condition of such acid treatment is not limited as long as it can convert the salt type carboxyl groups present in the fiber outer layer into acid type. However, it is desirable to carry out the treatment in an acid bath at a pH preferably not higher than 4, more preferably between pH 2.0 and 3.0, for a time not longer than 30 seconds, preferably for 8 to 15 seconds.

Thereafter, the gel fibers after the acid treatment and heat-stretching treatment are subjected to drying-compacting treatment. This treatment is desirably carried out under conditions of a dry-bulb temperature/wet-bulb temperature of not lower than 115°/not lower than 55° C., preferably not lower than 120° C./not lower than 60° C., and for a time preferably not shorter than 10 minutes. By this process step, microvoids generated in the heat stretching step are completely eliminated to compact the fiber structure and merge the water absorbing resin containing acid type carboxyl groups in the fiber outer layer with the fiber-forming matrix polymer (AN polymer).

As regards the above-mentioned wet-heat relaxing treatment, it is desirable that said treatment should be carried out in a hot water medium or in a saturated or superheated steam atmosphere under such a condition that the fibers after acid treatment will have a water-holding ratio increased by 1.5 times. Only after such a wet-heat treatment has been carried out, it is possible to attain enlargement and fixation of the pores present in the fibers and improvement in the water-absorbing ability resulting from the generation of pores passing to the outside of the fibers, as well as to provide acrylic fibers remarkably improved in physical properties such as strength, elongation, etc. and in color fastness. The condition of such wet-heat treatment will vary depending the kind of the AN polymer (the starting material) and water-absorbing resin, and on the spinning condition, and therefore it is difficult to prescribe it definitely. However, it is especially desirable to employ a temperature condition not lower than 100° C., preferably not lower than 120° C., in a saturated steam atmosphere because a remarkable effect can be obtained in a short time.

After the enlargement and heat-fixation of the pores in the fiber outer layer is carried out by the above-mentioned wet-heat relaxing treatment, if an additional acid treatment is carried out to convert substantially all the carboxyl groups in the water-absorbing resin present in the fiber outer layer into acid type carboxyl groups, the affinity of the fibers to cationic dyes will be made smaller to lower the dyeing speed, whereby the difficulty of dyeing uneveness will be further relieved. Therefore such additional acid treatment is recommended.

It is of course possible to composite-spin in the usual way at least two kinds of spinning solutions (one of which is a spinning solution compounded with water-absorbing resin and the other is a spinning solution containing no water-absorbing resin) into the form of sheath-core type, side-by-side type, sandwich type, random composite type, sea-and-islands type, etc. so that, for example, at least a part of the AN polymer containing no water-absorbing resin will be exposed on the fiber surface.

The water-absorbing acrylic fibers according to the present invention produced in this way should contain preferably not less than 5 pores having longer diameter not shorter than 0.2μ in the fiber inner layer, and have a water-holding ratio not less than 20%, preferably not less than 25%. Only by such fibers it is possible to exhibit a water-absorbing capacity and water-holding capacity comparable to cotton.

In addition, the fibers according to the present invention have a decrease in the water-holding ratio, after dry-heat treatment at 120° C. for one hour, of not more than 10%, preferably not more than 5%, so that in supplementary processing steps or in practical use, there is no substantial lowering in the water-absorbing capacity.

The above-mentioned water-absorbing acrylic fibers, only after being mixed with the specific water-absorbing resin and subjected to the particular acid treatment, etc., are given excellent physical properties such as strength, elongation, etc. and practical properties such as spinnability, color fastness, etc. The pores formed by compounding such a resin are very stable and do not readily disappear as is the case with microporous acrylic fibers, so that there is no substantial decrease in the water-absorbing ability. Furthermore, since the fiber structure is compacted while maintaining the pores in the fibers, the fibers are excellent in physical properties such as strength and elongation. In particular, because of the fiber surface properties of extremely few pores in the fiber outer layer, the fibers are remarkably improved in dyeing characteristics, and at the same time the fibers are also excellent in color development and practical properties such as color fastness against sweat, washing and wet-rubbing. Moreover, the fibers can have excellent spinnability since the surface resistance of the fibers can be effectively decreased by the application of a small amount of spinning oil. In addition, the water-absorbing acrylic fibers according to the present invention are easily controlled with respect to their water-absorbing ability by varying the amount, kind, etc. of the water-absorbing resin to be compounded and the acid treatment condition. Also, the water-absorbing fibers of the present invention are free from any troubles in the production, such as spinnerette clogging, filament breakage, entanglement and fusion, and free from the disadvantages of absorbing a large amount of dyes and spinning oils as is the case with the conventional existing microporous, water-absorbing acrylic fibers. Thus the fibers of the present invention have many industrial advantages.

The acrylic fibers of the present invention having many advantages in the production process and in practical properties can be used singly or in mixture with various synthetic fibers sold on the market, such as polyester, polyamide, polyacrylic or modacrylic fibers, as material for comfortable underwear, sheeting, toweling, sportswear, summer clothing, etc.

In the following the effect produced by the present invention will be explained in further detail by way of examples wherein parts and percentages are by weight unless otherwise indicated.

In the following examples, the water-swellability and the amount of —COOX groups of the water-absorbing resin, and the water-holding ratio and color development of the fibers were measured and calculated according to the following methods:

(1) Degree of water-swellability (cc/g)

About 0.5 gram of water-absorbing resin is immersed in pure water at 25° C. After 24 hours, the water-absorbing resin in a swollen state is placed between pieces of filter paper to remove excess water held among the resin particles. The weight ($W_1$) of the sample thus prepared is measured. The sample is then dried in a vacuum drier at 80° C. until it reaches a constant weight ($W_2$). From the above measurement results, the degree of water-swellability is calculated by the following formula:

$$\text{Degree of water-swellability} = \frac{W_1 - W_2}{W_2}$$

(2) Water-holding ratio (%)

About 5 g sample is immersed in pure water at 25±3° C. After 2 hours, the water held among the fibers is removed by a centrifuge (produced by Kokusan Enshinki Co. Ltd.; radius 12 cm) at 2,000 rpm for 5 minutes. The weight of the sample thus prepared is measured ($w_1$). The sample is then dried in a hot air current drier at 80° C. until it reaches a constant weight ($w_2$). From the above measurement results, the water-holding ratio is calculated by the following formula:

$$\text{Water-holding ratio} = \frac{w_1 - w_2}{w_2} \times 100$$

(3) Amount of carboxyl groups (m mol/g)

About one gram of thoroughly dried sample is weighed accurately (X g). After 200 ml water is added to this sample, an aqueous 1N hydrochloric acid is added while heating to 50° C. to adjust the pH to 2. Then a titration curve is obtained in the usual way using an aqueous 0.1N caustic soda solution. From this titration curve, the amount of the caustic soda solution consumed by the carboxyl groups is obtained (Y). From the results of the above measurement, the amount of the carboxyl groups is calculated by the following formula:

$$\text{Amount of —COOX groups} = \frac{0.1\ Y}{X}$$

If polyvalent cations are contained, the above formula must be corrected by obtaining the amount of these cations in the usual way.

(4) Color development (K/S ratio)

After causing the fibers for measurement to completely absorb 0.5% o.w.f. (=based on the dry weight of the fibers) Aizen Cathilon Blue K-2GLH (a cationic dye produced by Hodogaya Chemical Co.), the fibers are dried at 60° C. for 60 minutes. The reflexive color depth ($K_1/S_1$ value) of the dyed product after drying is measured by a Hunter reflexive light meter (Color Machine CM-20; Color Machine K.K.) and K/S ratio is calculated by the following formula:

$$K/S \text{ ratio} = \frac{(K_1/S_1)}{(K_2/S_2)} \times 100\ (\%)$$

wherein ($K_2/S_2$) shows the reflexive color depth obtained by the above-mentioned procedure, of a dyed product of ordinary acrylic fibers. The formula means that the larger the K/S ratio, the smaller is the degree of deterioration of the color development of the final fibers.

EXAMPLE 1

One hundred parts of each of the monomer compositions shown in Table 1 and 233 parts of water were placed into an autoclave of 2 liter capacity. After adding di-tert-butylperoxide as the polymerization initiator in an amount of 0.5% based on the monomer composition, the autoclave was closed tightly. Polymerization was carried out under stirring at 150° C. for 20 minutes. After the completion of the reaction, the reaction system was cooled to about 90° C. while continuing stirring. The reaction product was then taken out of the autoclave. Thus three kinds of cross-linked AN copolymer emulsions (a, b, c) were produced. All of the particle diameters of the polymer dispersed in these emulsions were about 0.1μ.

Each of the emulsions thus obtained was alkali-treated in a 3% aqueous caustic soda solution at 95° C. for 60 minutes. All of the water-absorbing resins (A, B, C) thus obtained had a particle diameter of about 0.1μ. In Resins B and C, a core part of cross-linked AN copolymer remained, but Resin A had substantially no core part remaining. The results of measurement of the degree of water swellability and the amount of —COONa groups of the water-absorbing resins are given in Table 1.

TABLE 1

| | Cross-linked AN copolymer | | | | |
|---|---|---|---|---|---|
| No. | No. | Monomer composition | —COONa (mmol l/g) | Water-swellability (cc/g) |
| A | a | AN/MMA/MBA/SPSS =77.8/20/0.2/2 | 9.5 | 350 |
| B | b | AN/MA/DVB/SPSS =74/20/4/2 | 5.7 | 45 |
| C | c | AN/MMA/MBA/SPSS =76/20/2/2 | 4.3 | 30 |

Note:
MMA = Methyl methacrylate
DVB = Divinylbenzene
MBA = Methylenebisacrylamide
SPSS = Sodium p-styrene sulfonate To a spinning solution composed of 10 parts of an AN polymer (intrinsic viscosity [η] in dimethylformamide at 30° C.=1.3) consisting of 90% AN, 9.7% methyl acrylate and 0.3% sodium methallyl sulfonate, was added a 10% aqueous dispersion of the water-absorbing resin (the viscosity of which was regulated to 100 cp by adding sodium thiocyanate) so that it amounted to 2% based on the total amount of the AN polymer and the water absorbing resin. The spinning solution was then extruded into a 15% aqueous sodium thiocyanate solution at 0° C. through a spinnerette having orifices of 0.075 mm in diameter to coagulate the spinning solution into fibers, which were then cold-stretched twice in length and washed with water. After the water-washed gel fibers were treated in a nitric acid solution (first bath) at pH 2.7 for 10 seconds, the fibers were heat-stretched 5.0 times in boiling water, and were subjected to drying-compacting treatment in normal pressure atmosphere at a dry-bulb temperature/wet-bulb temperature of 120° C./65° C. for 15 minutes. The fibers were then subjected to relaxing treatment in saturated steam at 130° C. for 10 minutes, and were treated in a nitric acid solution (second bath) at pH 2.1 for 10 seconds. After water-washing, 0.4% of an anionic surface-active agent (Mapole 100 produced by Matsumoto Oil and Fat Co. Ltd.) was applied to the fibers and dried at 110° C. for 10 minutes to produce three kinds of fibers (I, II, III) having a single-filament denier of 3 d. Fibers (IV) and Fibers (V) were produced in the same way as in Fibers (III) except that the second bath was omitted for the former and the first and second baths were omitted for the latter.

The water-holding ratio, color dye development and dyeing speed of these fibers are shown in Table 2.

TABLE 2

| Sample no. | water-absorbing resin No. | Water-swellability (cc/g) | pH of acid-treatment 1st bath | pH of acid-treatment 2nd bath | Characteristics of water-absorbing fibers: Water-holding ratio (%) | K/S ratio | Dyeing speed (1) (%) | (2) |
|---|---|---|---|---|---|---|---|---|
| I | A | 350 | 2.7 | 2.1 | 54 | 51 | 50 | |
| II | B | 45 | 2.7 | 2.1 | 37 | 66 | 28 | O |
| III | C | 30 | 2.7 | 2.1 | 27 | 65 | 30 | O |
| IV | C | 30 | 2.7 | — | 28 | 58 | 38 | O |
| V | C | 30 | — | — | 29 | 40 | 65 | |

Note (1) Dyeing speed (%) is a value of dye exhaustion ratio obtained by residual bath colorimetry, when the sample fibers are dyed according to the following dyeing formulation:
Aizen Cathilon Red GTLT 6.5% o.w.f. (produced by Hodogaya Chemical Co.)
Acetic acid 2.0% o.w.f.
Sodium acetate 1.0% o.w.f.
Bath ratio 1/125
Temperature × time 85° C. × 30 minutes
Note (2) O marks: example of the present invention.

As apparent from the results in the above Table, it is understood that the fibers according to the present invention (Nos. II–IV) are excellent both in water-absorbing ability (water-holding ratio) and in dyeing characteristics, while the Fibers (V), for which the acid treatment was omitted, there is a problem in dyeing characteristics.

In the case of Fibers (I) produced by using the water-absorbing resin (A) having a degree of water-swellability exceeding the range recommended in the present invention, the water-absorbing ability was large, but it was impossible to obtain satisfactory fibers because of frequent filament breakage. In the case of Fibers (II–V) produced by using the water-absorbing resins (B and C) according to the present invention, the fine particles of the water-absorbing resins were uniformly dispersed without agglomeration, so that there were no problems such as nozzle clogging, filament breakage, etc.

EXAMPLE 2

Four kinds of fibers (VI–IX) were produced according to the same formulation as in Fibers (II) of Example 1 except that the amounts of mixing of the resin were changed as described in Table 3.

The results of measurement of the characteristics of these fibers are shown in Table 3.

TABLE 3

| Sample no. | Amount of water-absorbing resin (B) (%) | Fiber characteristics: Water-holding ratio (%) | K/S ratio | Dyeing speed (%) | |
|---|---|---|---|---|---|
| VI | 0.3 | 18 | 83 | 15 | |
| VII | 1.5 | 32 | 70 | 23 | O |
| VIII | 5.0 | 67 | 55 | 39 | O |

TABLE 3-continued

| Sample no. | Amount of water-absorbing resin (B) (%) | Fiber characteristics: Water-holding ratio (%) | K/S ratio | Dyeing speed (%) |
|---|---|---|---|---|
| IX | 10.5 | — | — | — |

As apparent from the results in the above Table, the Fibers VII and VIII according to the present invention were excellent both in spinnability and fiber characteristics, but in the case of Fibers (VI), of which the amount of mixing of the resin was less than the preferred range of the present invention, the water-absorbing ability was insufficient. Also, in the case of Fibers (IX), of which the amount of mixing of the resin exceeded said range, there was frequent occurrence of nozzle clogging and filament breakage, so that it was impossible to obtain fibers satisfactory for practical use.

What is claimed is:

1. Water-absorbing acrylic fiber having an outer and an inner layer and being composed of not less than 90 weight % of an acrylonitrile polymer and having dispersed therein less than 10 weight % of water-absorbing resin particles containing carboxyl groups, represented by —COOX wherein X is H, $NH_4$ or an alkali metal and said resin having substantially no water-swellability when X is H and having a degree of water-swellability of 10–300 cc/g when X is $NH_4$ or an alkali metal, the particle diameter of which resin being not larger than 0.5μ at absolute dryness, the particles of water-absorbing resin present at least in the outer layer of the fibers having carboxyl groups wherein X is H, the particles of water-absorbing resin present in the inner layer having said carboxyl groups wherein X=$NH_4$ or alkali metal and said particles being present in an amount sufficient to render the fiber water-absorbing, a cross-section of said fibers containing not less than 5 pores no smaller than 0.2μ in their maximum diameter and said fibers having a water-holding ratio not lower than 20%, said fibers being obtained by wet-spinning a spinning solution composed of an acrylonitrile polymer and said water-absorbing resin particles, water-washing the resulting fibers, acid treating the fibers at a pH not higher than 4, subjecting the fibers to heat-stretching treatment and dry-compacting treatment, followed by wet-heat relaxing treatment at a temperature not lower than 110° C. and then drying the fibers at 105°–170° C., the water-absorbing resin being present at 0.5 to 7 wt. %.

2. The water-absorbing acrylic fibers as claimed in claim 1 wherein the acrylonitrile polymer is a copolymer of not less than 80 weight % of acrylonitrile and the remainder of another vinyl monomer.

3. The water-absorbing acrylic fibers as claimed in claim 1 wherein the water-absorbing resin contains not less than 1.5 m mol/g carboxyl groups.

* * * * *